US008786205B2

(12) United States Patent
Zhang et al.

(10) Patent No.: US 8,786,205 B2
(45) Date of Patent: Jul. 22, 2014

(54) METHOD AND APPARATUS FOR LED LIGHTING

(75) Inventors: Wanfeng Zhang, Palo Alto, CA (US); InHwan Oh, Cupertino, CA (US)

(73) Assignee: Marvell World Trade Ltd., St. Michael (BB)

( * ) Notice: Subject to any disclaimer, the term of this patent is extended or adjusted under 35 U.S.C. 154(b) by 53 days.

(21) Appl. No.: 13/585,170

(22) Filed: Aug. 14, 2012

(65) Prior Publication Data

US 2013/0049626 A1 Feb. 28, 2013

Related U.S. Application Data

(60) Provisional application No. 61/526,507, filed on Aug. 23, 2011.

(51) Int. Cl.
*G05F 1/12* (2006.01)
*H05B 37/00* (2006.01)

(52) U.S. Cl.
USPC ..... 315/240; 315/192

(58) Field of Classification Search
USPC ..... 315/240, 291, 247, 297, 294, 307, 313, 315/192; 323/271; 363/127, 89
See application file for complete search history.

(56) References Cited

U.S. PATENT DOCUMENTS

2004/0155605 A1 8/2004 Hosono et al.
2005/0105311 A1* 5/2005 Soldano ..... 363/89
2010/0295472 A1 11/2010 Wibben et al.
2011/0075462 A1 3/2011 Wildash
2012/0299512 A1* 11/2012 Watanabe et al. ..... 315/307

OTHER PUBLICATIONS

International Search Report and Written Opinion issued Oct. 9, 2012 in International Application No. PCT/US2012/050739.

* cited by examiner

*Primary Examiner* — Daniel D Chang

(57) ABSTRACT

Aspects of the disclosure provide a circuit. The circuit includes a first switch, a second switch and a controller. The first switch is switched on and off to allow a boost circuit to transfer electric energy from an input power supply to a capacitor to generate an intermediate power supply having a higher voltage than the input power supply. The second switch is switched on and off to allow a buck circuit to provide a driving voltage based on the intermediate power supply to drive a load device, and to regulate a current to the load device. The controller is configured to provide a first signal to the first switch and a second signal to the second switch to switch on and off the first switch and the second switch.

20 Claims, 11 Drawing Sheets

METHOD AND APPARATUS FOR LED LIGHTING

INCORPORATION BY REFERENCE

This present disclosure claims the benefit of U.S. Provisional Application No. 61/526,507, "New LED Current Regulator For LED Lighting With Electronic Transformer" filed on Aug. 23, 2011, which is incorporated herein by reference in its entirety.

BACKGROUND

The background description provided herein is for the purpose of generally presenting the context of the disclosure. Work of the presently named inventors, to the extent the work is described in this background section, as well as aspects of the description that may not otherwise qualify as prior art at the time of filing, are neither expressly nor impliedly admitted as prior art against the present disclosure.

Light emitting diode (LED) lighting devices provide the advantages of low power consumption and long service life. Thus, LED lighting devices may be used as general lighting equipment in the near future to replace, for example, fluorescent lamps, bulbs, halogen lamps, and the like.

SUMMARY

Aspects of the disclosure provide a circuit. The circuit includes a first transistor, a second transistor and a controller configured to provide a first signal to the first transistor and a second signal to the second transistor to switch on and off the first transistor and the second transistor. The first transistor is coupled to a first inductor, a first diode, and a capacitor in a boost configuration. The first transistor is switched on and off to transfer electric energy from an input power supply to the capacitor to generate an intermediate power supply having a higher voltage than the input power supply. The second transistor is coupled to a second inductor and a second diode in a buck configuration to provide a driving voltage based on the intermediate power supply to drive a load device. The second transistor is switched on and off to regulate a current to the load device.

According to an aspect of the disclosure, the first transistor is switched on and off to transfer electric energy from an alternating current (AC) power supply generated from an electronic transformer. In an example, the first transistor is switched on and off to transfer the electric energy through a rectifier that rectifies the AC power supply to have a single polarity. In another example, the first transistor and the first diode are forward-biased when the AC power supply has a first polarity and are reverse-biased to be decoupled from the first inductor and the capacitor when the AC power supply has a second polarity. The circuit includes a third transistor. The third transistor and a third diode are forward-biased to be coupled with the first inductor and the capacitor in the boost configuration when the AC power supply has the second polarity. The controller is configured to provide a third signal to the third transistor to switch on and off the third transistor. The third signal can be the same as the first signal.

According to an embodiment of the disclosure, the load device is a first load device. The circuit includes a fourth transistor. The fourth transistor is coupled to a third inductor, and a fourth diode in a buck configuration to provide a second driving voltage based on the intermediate power supply to drive a second load device. The fourth transistor is switched on and off to regulate a second driving current to the second load device. In an example, the first and second load devices are light emitting diode (LED) lighting devices.

According to an aspect of the disclosure, the controller is configured to provide first pulses having a first duty cycle to the first transistor, and provide second pulses having a second duty cycle to the second transistor. In an embodiment, the controller is configured to adjust the first duty cycle based on a feedback signal indicative of a voltage level of the intermediate power supply. In another embodiment, the controller is configured to adjust the second duty cycle based on a feedback signal indicative of a current flowing through the load device.

Aspects of the disclosure provide an apparatus. The apparatus includes a first transistor, a first inductor, a first diode, and a capacitor coupled in a boost configuration. Further, the apparatus includes a second transistor, a second inductor and a second diode coupled in a buck configuration. Then, the apparatus includes a controller configured to provide a first signal to the first transistor to switch on and off the first transistor to transfer electric energy from an input power supply to the capacitor to generate an intermediate power supply having a higher voltage than the input power supply, and to provide a second signal to the second transistor to switch on and off the second transistor to provide a driving voltage based on the intermediate power supply to drive a load device.

Aspects of the disclosure provide a method. The method includes providing first pulses to a first transistor coupled to a first inductor, a first diode, and a capacitor in a boost configuration to switch on and off the first transistor in order to transfer electric energy from an input power supply to the capacitor to generate an intermediate power supply having a higher voltage than the input power supply. Further, the method includes providing second pulses to a second transistor coupled to a second inductor and a second diode in a buck configuration to provide a driving voltage based on the intermediate power supply to drive a load device.

BRIEF DESCRIPTION OF THE DRAWINGS

Various embodiments of this disclosure that are proposed as examples will be described in detail with reference to the following figures, wherein like numerals reference like elements, and wherein.

DETAILED DESCRIPTION OF EMBODIMENTS

Figure 1:
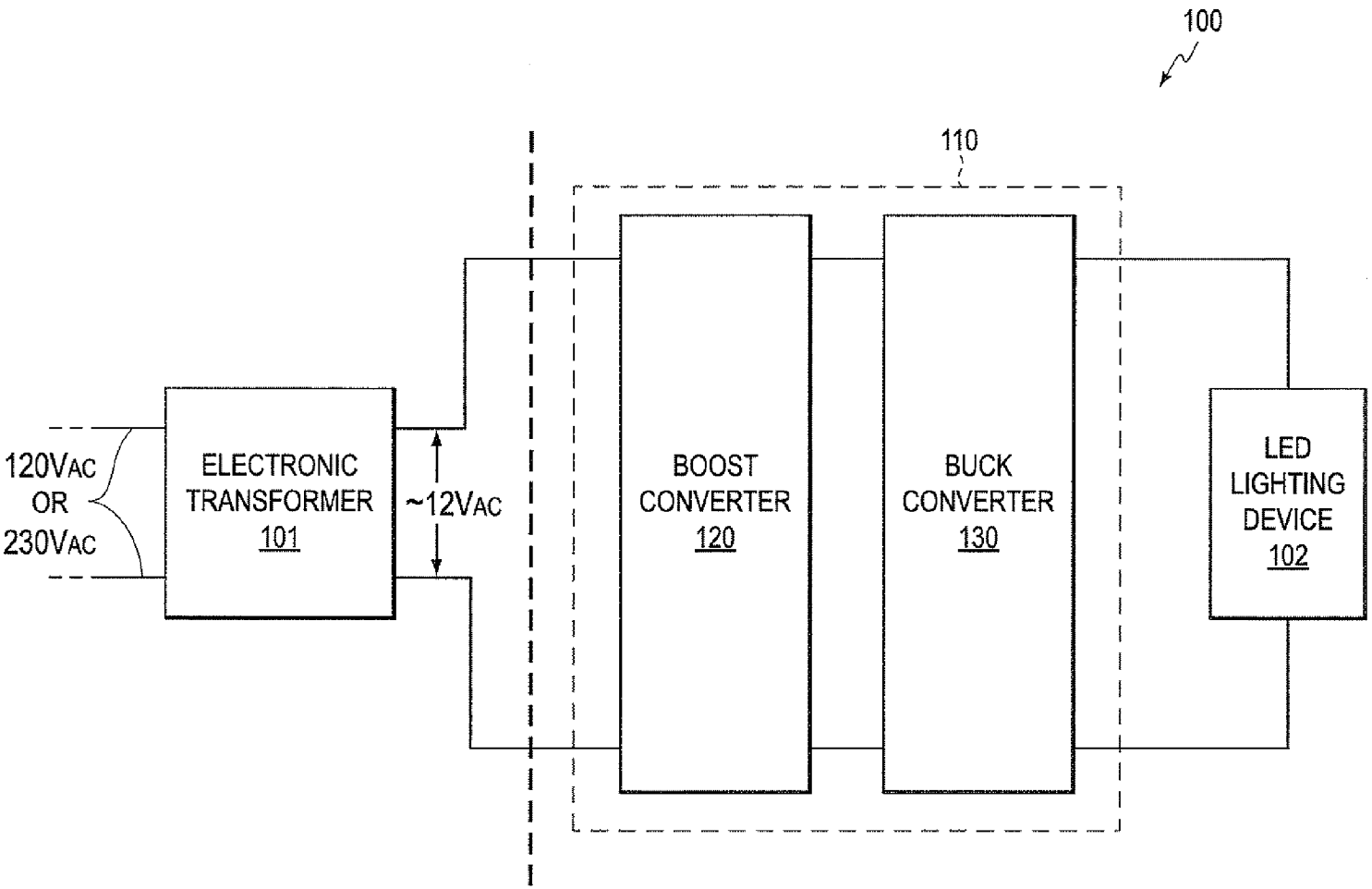
FIG. 1 shows a block diagram of a lighting system 100 according to an embodiment of the disclosure.

FIG. 1 shows a block diagram of a lighting system 100 according to an embodiment of the disclosure. The lighting system 100 includes a driver 110 and a lighting device 102 coupled together as shown in FIG. 1. The driver 110 receives electric energy from an input power supply and converts the electric energy into a suitable form for driving the lighting device 102.

In the FIG. 1 example, the input power supply is provided by an electronic transformer 101. In an example, the electronic transformer 101 is pre-installed for supplying power to a different lighting device than the lighting device 102, such as a Halogen lamp. It is noted that, generally, it is preferred that a Halogen lamp operates at 12V-24V alternating current (AC) voltage supply. In the FIG. 1 example, the electronic transformer 101 is configured to convert a first AC voltage supply of a relatively high AC voltage, such as 120V or 230V AC voltage supply, to a second AC voltage supply of a relatively low AC voltage, such as 12V AC voltage supply.

In the FIG. 1 example, the lighting device 102 is a light emitting diode (LED) lighting device. According to an embodiment of the disclosure, the LED lighting device 102 may require a supply voltage that is higher than a supply voltage of the input power supply provided by the electronic transformer 101. In an example, the LED lighting device 102 includes a number of serially connected light emitting diodes. Each light emitting diode has a forward voltage drop, such as about 2V and the like, for emitting light. When the number of the serially connected light emitting diodes is larger than, for example 9, the LED lighting device 102 requires a supply voltage that is higher than a peak voltage (about 17V) of the 12V AC voltage supply.

According to an embodiment of the disclosure, the driver 110 is configured to be able to drive a relatively large variety of the LED lighting device 102 that the number of the serially connected light emitting diodes falls in a relatively large range, such as from a single light emitting diode to twenty serially connected light emitting diodes, and the like. In the FIG. 1 example, the driver 110 includes a boost converter 120 and a buck converter 130. The boost converter 120 is configured to receive the input power supply, and generate an intermediate power supply having an intermediate voltage that is higher than the supply voltage of the input power supply. The buck converter 130 is configured to convert the intermediate voltage to a driving voltage that is suitable for the LED lighting device 102, and regulate a driving current to the LED lighting device 102.

In an example, the boost converter 120 receives the 12V AC supply voltage from the electronic transformer 101, boosts a voltage level, and generates the intermediate power supply to have a higher voltage level, such as 40V intermediate voltage. Then, the buck converter 130 converts the intermediate voltage to the driving voltage to suit a driving voltage requirement of the LED lighting device 102, and regulates the driving current to the LED lighting device 102. For example, when the LED lighting device 102 requires 10V driving voltage, the buck converter 130 provides the driving voltage of about 10V. When the LED lighting device 102 requires 30V, the buck converter 130 provides the driving voltage of about 30V. Thus, the driver 110 is able to drive an LED lighting device 102 having up to twenty serially connected light emitting diodes.

Figure 2:
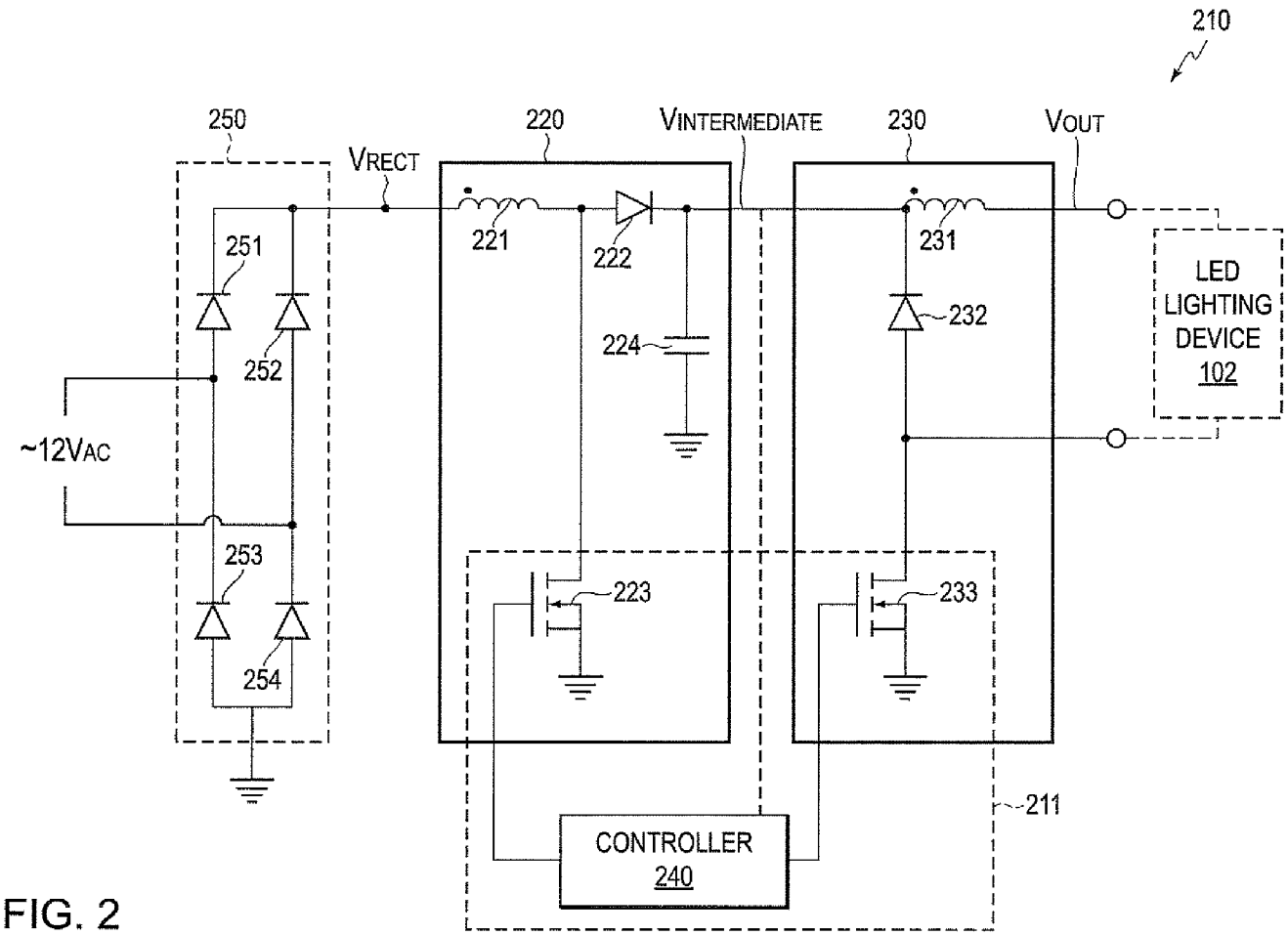
FIG. 2 shows a block diagram of a driver 210 according to an embodiment of the disclosure.

FIG. 2 shows a block diagram of a driver 210 according to an embodiment of the disclosure. The driver 210 can be used in the place of the driver 110 in the electronic system 100. The driver 210 includes a boost converter 220, and a buck converter 230. In addition, in the FIG. 2 example, the driver 210 includes a rectifier 250, and a controller 240. These elements are coupled together as shown in FIG. 2.

The rectifier 250 rectifies a received AC voltage to a fixed polarity, such as to be positive. In the FIG. 2 example, the rectifier 250 is a bridge rectifier 250 that includes four diodes 251-254 coupled together as shown in FIG. 2. The bridge rectifier 250 receives an AC voltage, such as 12V AC voltage ($12V_{AC}$) having a frequency of 50 Hz or 60 Hz, generates a rectified voltage $V_{RECT}$, and provides the rectified voltage $V_{RECT}$ to the boost converter 220. It is noted that the 12V AC voltage has a peak voltage of about 17V. Generally, the diodes 251-254 have forward voltage drops, such as about 0.7V per diode. The forward voltage drops on the diodes 251-254 can cause power loss, and a peak voltage of the rectified voltage $V_{RECT}$ is lower than the peak voltage of the 12V AC voltage.

The boost converter 220 receives the rectified voltage $V_{RECT}$ and generates an intermediate voltage $B_{INTERMEDIATE}$ that is higher than the peak voltage of the rectified voltage $V_{RECT}$. In the FIG. 2 example, the boost converter 220 includes an inductor 221, a switch 223, a diode 222 and a capacitor 224. These elements are coupled together in a boost configuration as shown in FIG. 2.

According to an embodiment of the disclosure, the switch 223 is implemented using a transistor, such as an N-type metal-oxide-semiconductor-field-effect-transistor (MOSFET), and the like. The controller 240 provides a gate control signal to a gate terminal of the transistor 223 to turn on and turn off the transistor 223. In an example, the controller 240 provides pulses having a relatively high frequency, such as in the order of 100 KHz, to control the gate terminal of the transistor 223. In an embodiment, the controller 240 monitors an intermediate voltage $V_{INTERMEDIATE}$, and adjusts a duty cycle of the pulses based on the monitored intermediate voltage $V_{INTERMEDIATE}$ to maintain the intermediate voltage $V_{INTERMEDIATE}$ in a desired range, such as about 40V, and the like.

During operation, in an example, when the transistor 223 is turned on, the rectified voltage $V_{RECT}$ is impressed across the inductor 221, the diode 222 prevents the capacitor 224 from discharging to ground, and electric energy is stored in the inductor 221. When the transistor 223 is turned off, the voltage across the inductor 221 changes to whatever is required to maintain current flow. In order for current to continue flowing, the voltage across the inductor 221 forward biases the diode 222, and the stored electric energy in the inductor 221 is transferred to the capacitor 224.

It is noted that the transferred electric energy is a function of a duty cycle (D1) of pulses that control the gate terminal of the transistor 223. In an example, the controller 240 receives a feedback signal indicative of the voltage level of the intermediate voltage $V_{INTERMEDIATE}$, and adjusts the duty cycle (D1) based on the feedback signal to maintain the intermediate voltage $V_{INTERMEDIATE}$ in a desired range, such as from a lower limit to an upper limit. For example, when the feedback signal indicates that the intermediate voltage $V_{INTERMEDIATE}$ is lower than the lower limit, the controller 240 provides pulses with increased duty cycle D1; and when the feedback signal indicates that the intermediate voltage $V_{INTERMEDIATE}$ is higher than the upper limit, the controller 240 provides pulses with decreased duty cycle D1.

The buck converter 230 receives the intermediate voltage $V_{INTERMEDIATE}$, generates an output voltage $V_{OUT}$ to drive a load device, such as the LED lighting device 102, and regulates a driving current to the LED lighting device 102. In the FIG. 2 example, the buck converter 230 includes an inductor 231, a switch 233 and a diode 232. These elements are coupled together in a buck configuration as shown in FIG. 2.

According to an embodiment of the disclosure, the switch 233 is implemented using a transistor, such as an N-type MOSFET, and the like. The controller 240 provides a gate control signal to a gate terminal of the transistor 233 to turn on and turn off the transistor 233. In an example, the controller 240 provides pulses having a relatively high frequency, such as in the order of 100 KHz, to control the gate terminal of the transistor 233.

During operation, in an example, when the transistor 233 is turned on, the voltage across the inductor 231 ($V_{L231}$) is expressed in Eq. 1:

$$V_{L231}=V_{INTERMEDIATE}-V_{OUT} \quad \text{Eq. 1}$$

The current flows through the inductor 231, the LED lighting device 102, and the transistor 233 to ground. The inductor 231 stores electric energy. The diode 232 is reverse-biased, no current flows through the diode 232.

When the transistor 233 is turned off, the diode 232 is forward biased, and the voltage across the inductor 231 is expressed in Eq. 2

$$V_{L231}=-V_{OUT} \quad \text{Eq. 2}$$

The current flows through the inductor 231, the LED lighting device 102, and the diode 232. The inductor 231 transfers the stored electric energy to the LED lighting device 102.

According to an embodiment of the disclosure, a ratio of the output voltage $V_{OUT}$ to the intermediate voltage $V_{INTERMEDIATE}$ is a function of a duty cycle (D2) of pulses that control the gate terminal of the transistor 233. For example, the relationship is expressed in Eq. 3:

$$\frac{V_{OUT}}{V_{INTERMEDIATE}} = D2 \quad \text{Eq. 3}$$

In an example, the controller 240 receives a feedback signal (not shown) indicative of a current level of the current flowing in the LED lighting device 102, and adjusts the duty cycle (D2) of the pulses to the gate terminal to the transistor 233 based on the feedback signal to obtain an appropriate output voltage $V_{OUT}$ to the LED lighting device 102, and to regulate the current flowing in the LED lighting device 102.

For example, when the feedback signal indicates that the current flowing through the LED lighting device 102 is smaller than a lower current limit, for example, when the output voltage $V_{OUT}$ is too smaller to drive the LED lighting device 102, the controller 240 provides pulses with increased duty cycle D2 to increase the output voltage $V_{OUT}$. When the feedback signal indicates that the current flowing through the LED lighting device 102 is larger than an upper current limit, for example, when the output voltage VOUT is too large for the LED lighting device 102, the controller 240 provides pulses with decreased duty cycle D2.

According to an embodiment of the disclosure, the transistors 223 and 233 and the controller 240 are implemented on an integrated circuit (IC) chip 211. The IC chip 211 includes input/output (I/O) pins that couple a circuit in the IC chip 211 with other components of the driver 210. In an example, the diodes 222 and 232 are also implemented in the IC chip 211. In another example, the diodes 251-254 are also implemented in the IC chip 211.

It is noted that, in another embodiment, the transistors 223 and 233 and the controller 240 are implemented on multiple IC chips (not shown).

Figure 3A:
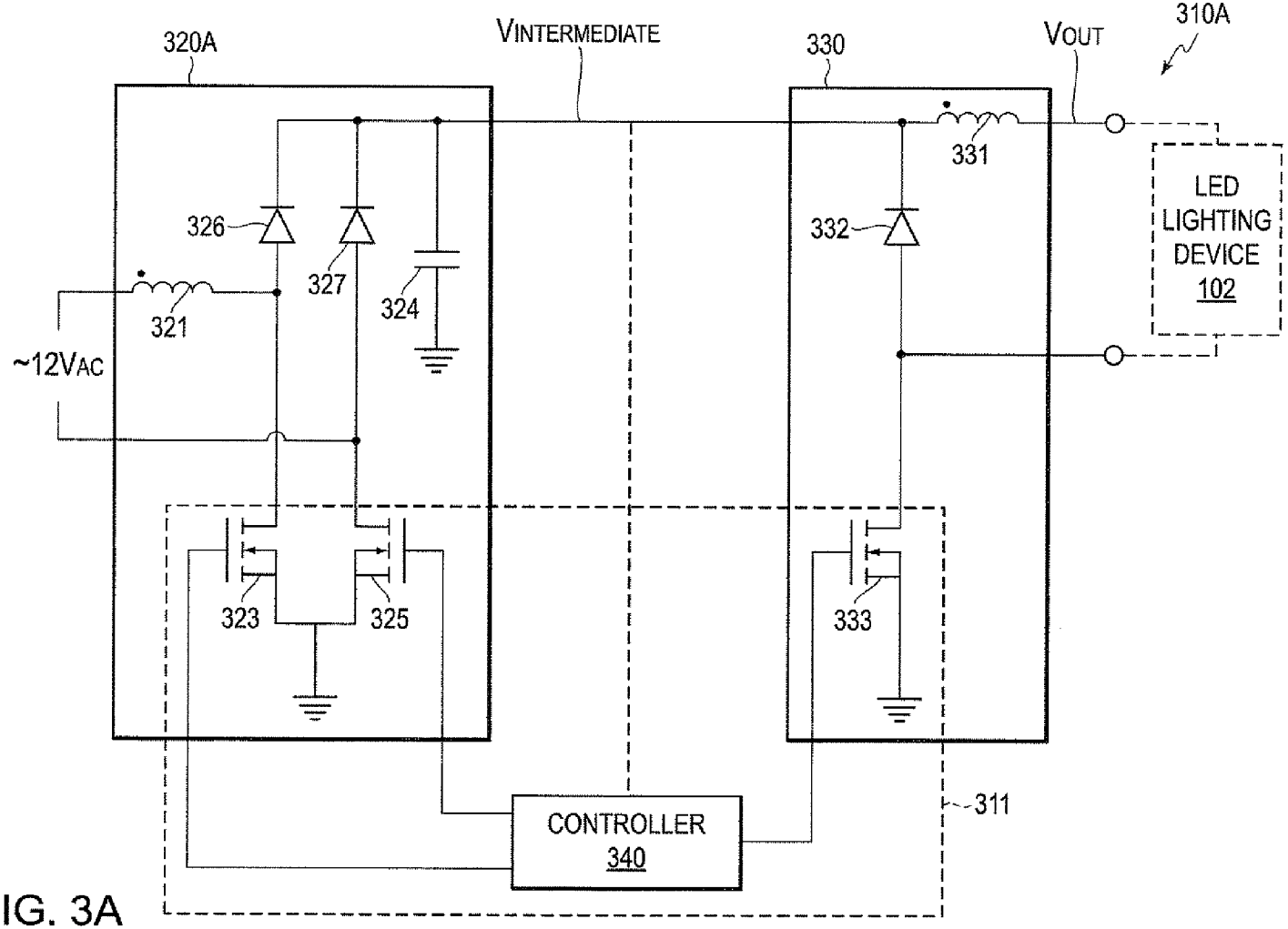
FIG. 3A shows a block diagram of another driver 310A according to an embodiment of the disclosure.

FIG. 3A shows a block diagram of another driver 310A according to an embodiment of the present disclosure. The driver 310A can be used in the place of the driver 110 in the electronic system 100. The driver 310A includes a boost converter 320A, and a buck converter 330. In addition, in the FIG. 3A example, the driver 310A includes a controller 340. These elements are coupled together as shown in FIG. 3A.

The boost converter 320A receives an AC voltage, such as 12V AC voltage having a frequency of 50 Hz or 60 Hz, and generates an intermediate voltage $V_{INTERMEDIATE}$ that has a fixed polarity, such as positive, and is higher than the peak voltage of the AC voltage. In the FIG. 3A example, the boost converter 320A includes an inductor 321, two diodes 326 and 327, two switches 323 and 325, and a capacitor 324. These elements are coupled together in a boost configuration as shown in FIG. 3A.

According to an embodiment of the present disclosure, the switches 323 and 325 are implemented using transistors, such as N-type MOSFET transistors, and the like. The controller 340 provides gate control signals to gate terminals of the transistors 323 and 325 to turn on and turn off the transistors 323 and 325. In an example, the controller 340 provides pulses having a relatively high frequency, such as in the order of 100 KHz, to control the gate terminals of the transistor 323 and 325. In an embodiment, the controller 340 monitors an intermediate voltage $V_{INTERMEDIATE}$, and adjusts a duty cycle (D1) of the pulses based on the monitored intermediate voltage $V_{INTERMEDIATE}$ to maintain the intermediate voltage $V_{INTERMEDIATE}$ in a desired range, such as about 40V, and the like.

According to an embodiment of the disclosure, the controller 340 provides the same gate control signals to the gate terminals of the transistors 323 and 325. It is noted that the controller 340 can provide different gate control signals to the gate terminals of the transistors 323 and 325.

The boost converter 320A operates similarly to the boost converter 220 described above. In an example, when the 12V AC voltage is positive, the diode 327 is reverse-biased, and the transistor 325 operates similarly to a reverse-biased diode. Thus, the diode 327 and the transistor 325 are decoupled from other components in the boost converter 320A. Further, the other components of the booster converter 320A operate identically or equivalently to the components in the booster converter 220. Specifically, the inductor 321 operates identically or equivalently to the inductor 221, the diode 326 operates identically or equivalently to the diode 222, the transistor 323 operates identically or equivalently to the transistor 223, and the capacitor 324 operates identically or equivalently to the capacitor 224. The description of these components has been provided above and will be omitted here for clarity purposes.

When the 12 AC voltage is negative, the diode 326 is reverse-biased and the transistor 323 operates similarly to a reverse-biased diode. Thus, the diode 326 and the transistor 323 are decoupled from the other components in the boost converter 320A. Further, the other components of the booster converter 320A operate identically or equivalently to the components in the booster converter 220. Specifically, the inductor 321 operates identically or equivalently to the inductor 221, the diode 327 operates identically or equivalently to the diode 222, the transistor 325 operates identically or equivalently to the transistor 223, and the capacitor 324 operates identically or equivalently to the capacitor 224. The description of these components has been provided above and will be omitted here for clarity purposes.

According to an embodiment of the disclosure, the driver 310A does not require a separate rectifier, and can save the power loss due to the voltage drops on the diodes in the separate rectifier.

The buck converter 330 operates identically or equivalently to the buck converter 230. The buck converter 330 utilizes components that are identical or equivalent to those used in buck converter 230; the description of these components has been provided above and will be omitted here for clarity purposes.

According to an embodiment of the disclosure, the transistors 323, 325 and 333 and the controller 340 are implemented on an integrated circuit (IC) chip 311. The IC chip 311 includes I/O pins that couple a circuit in the IC chip 311 with other components of the driver 310A. In an example, the diodes 326, 327 and 332 are also implemented in the IC chip 311.

It is noted that, in another embodiment, the transistors 323, 325 and 333 and the controller 340 are implemented on multiple IC chips (not shown).

It is noted that the driver 310A can be suitably modified.

Figure 3B:
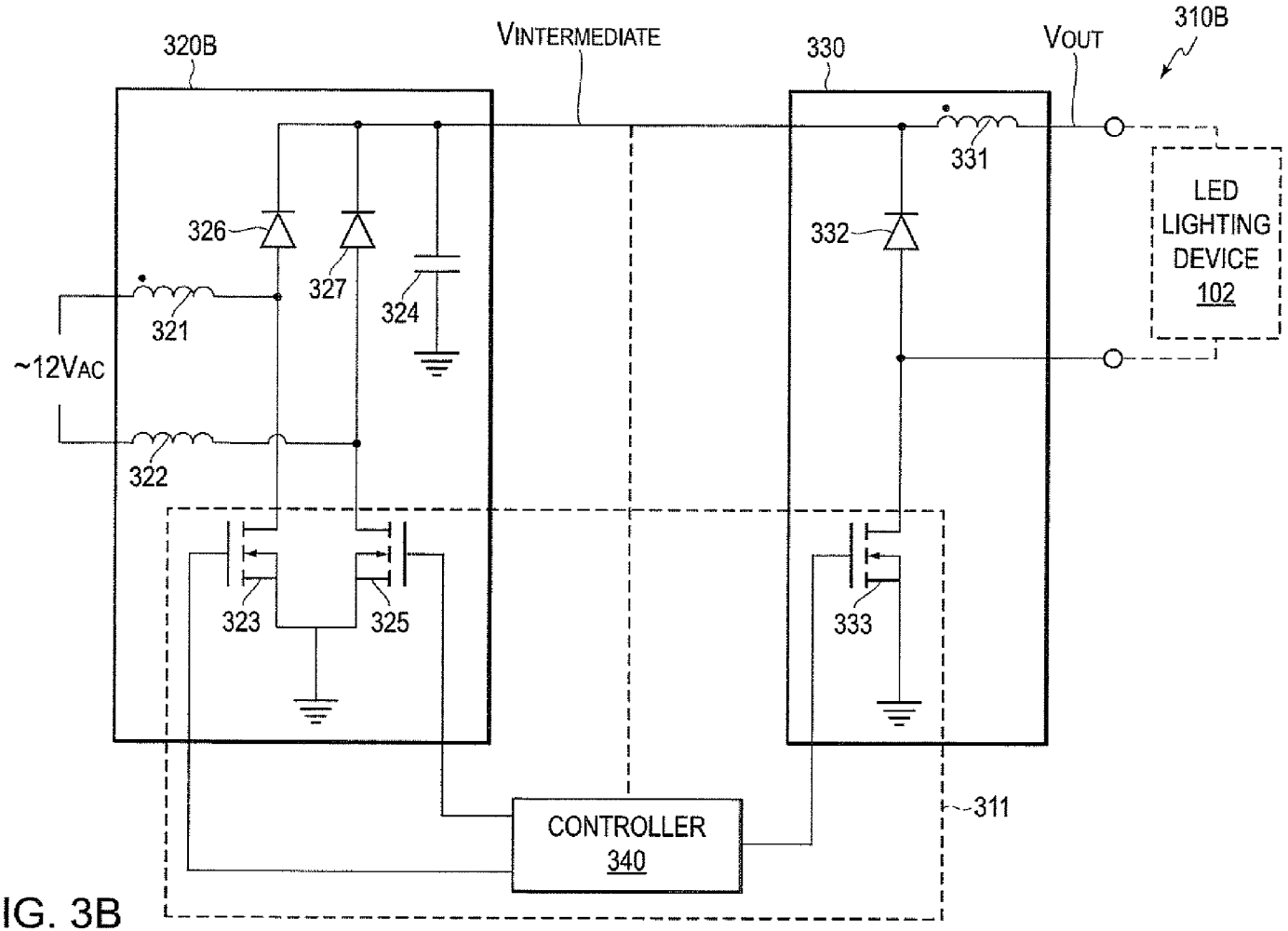
FIG. 3B shows a block diagram of another driver 310B according to an embodiment of the disclosure.

FIG. 3B shows a block diagram of another driver 310B according to an embodiment of the disclosure. The driver 310B utilizes certain components that are identical or equivalent to those used in the driver 310A; the description of these components has been provided above and will be omitted here for clarity purposes. The driver 310B also operates similarly to the driver 310A.

In the driver 310B, the booster converter 320B includes two inductors 321 and 322 that are respectively coupled to the two terminals of the AC power supply.

Figure 6A:
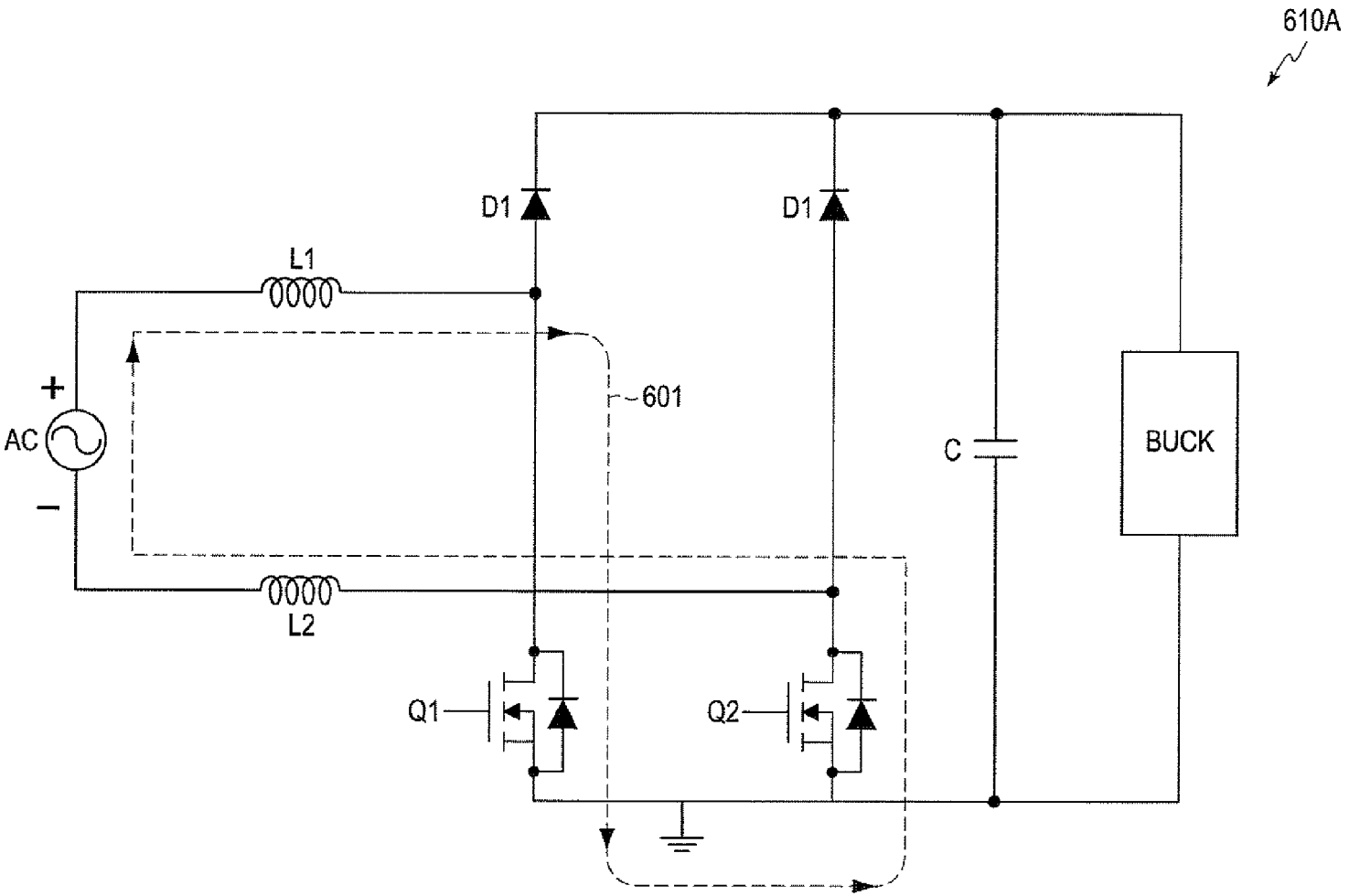
FIGS. 6A-6D show electric current directions in a driver during operation according to an embodiment of the disclosure.
Figure 6B:
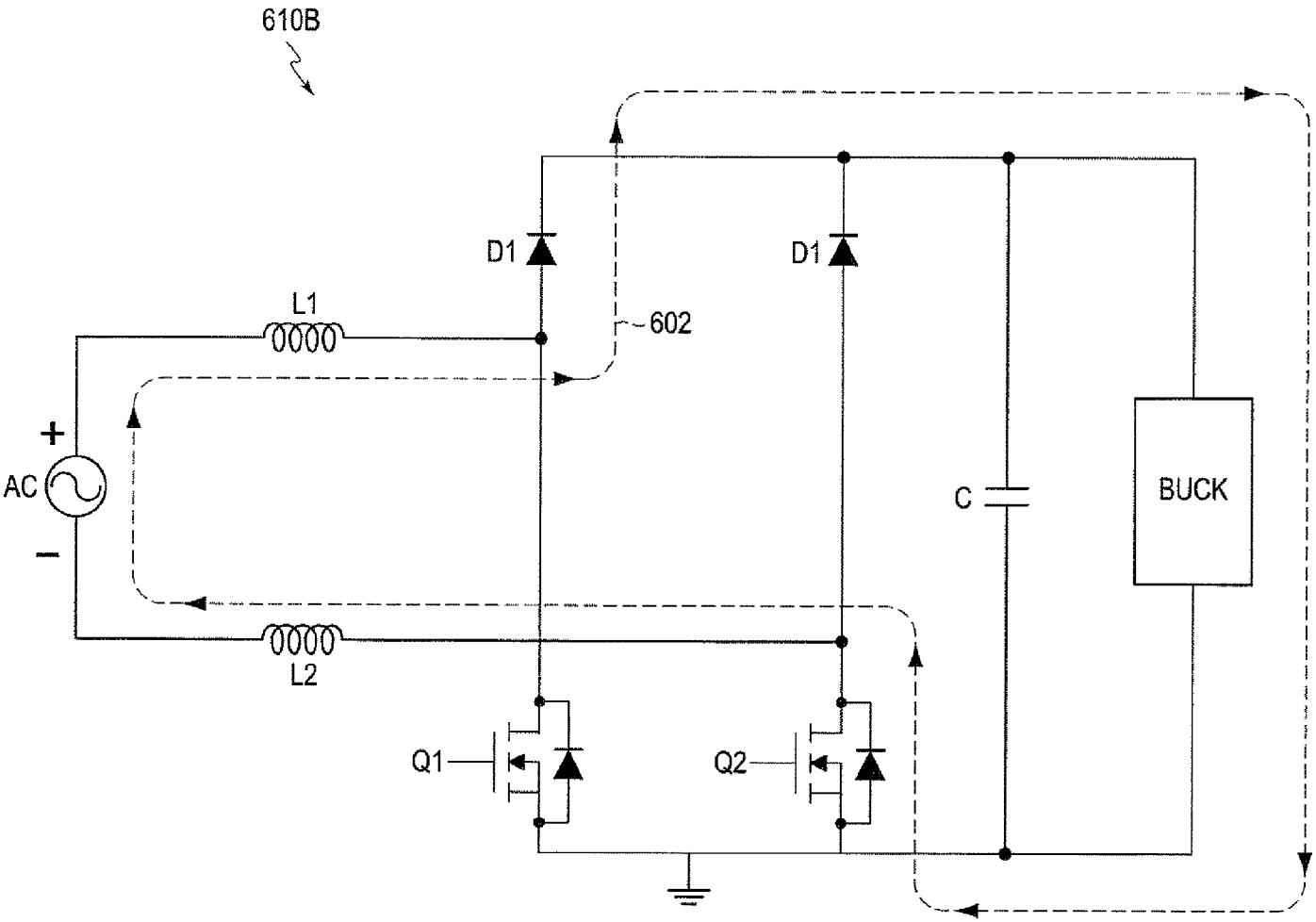

According to an embodiment of the disclosure, the directions of the electric current flowing in the driver 310B are shown in FIGS. 6A-6B. In the FIGS. 6A-6B, inductors L1 and L2 correspond to the inductors 321 and 322 in FIG. 3B; transistors Q1 and Q2 correspond to the transistors 323 and 325; diodes D1 and D2 correspond to the diodes 326 and 327; capacitor C corresponds to the capacitor 324; and the Buck load corresponds to the buck converter 330 with the load, such as the LED lighting device 102.

Specifically, in an example, the AC power supply provides an AC voltage having a sinusoidal waveform of 50 Hz. Further, the same control signals are provided to the transistors Q1 and Q2 to turn on and turn off the transistors Q1 and Q2 at a higher frequency, such as 100 KHz.

When the AC power supply is positive and the transistors Q1 and Q2 are turned on, the direction of the electric current flowing in the driver is shown by 601 in FIG. 6A.

When the AC power supply is positive and the transistors Q1 and Q2 are turned off, the direction of the electric current flowing in the driver is shown by 602 in FIG. 6B.

Figure 6C:
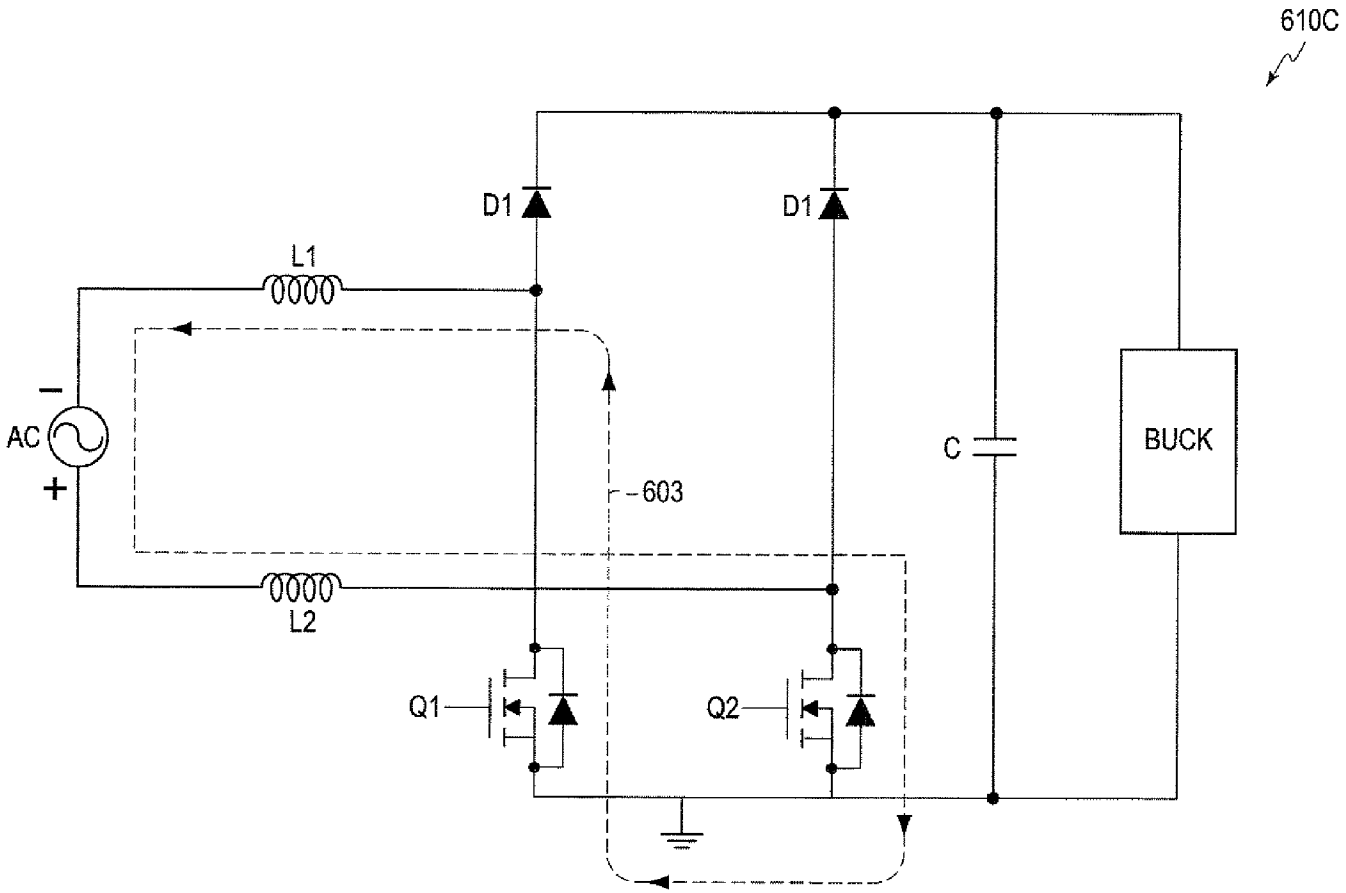

When the AC power supply is negative and the transistors Q1 and Q2 are turned on, the direction of the electric current flowing in the driver is shown by 603 in FIG. 6C.

Figure 6D:
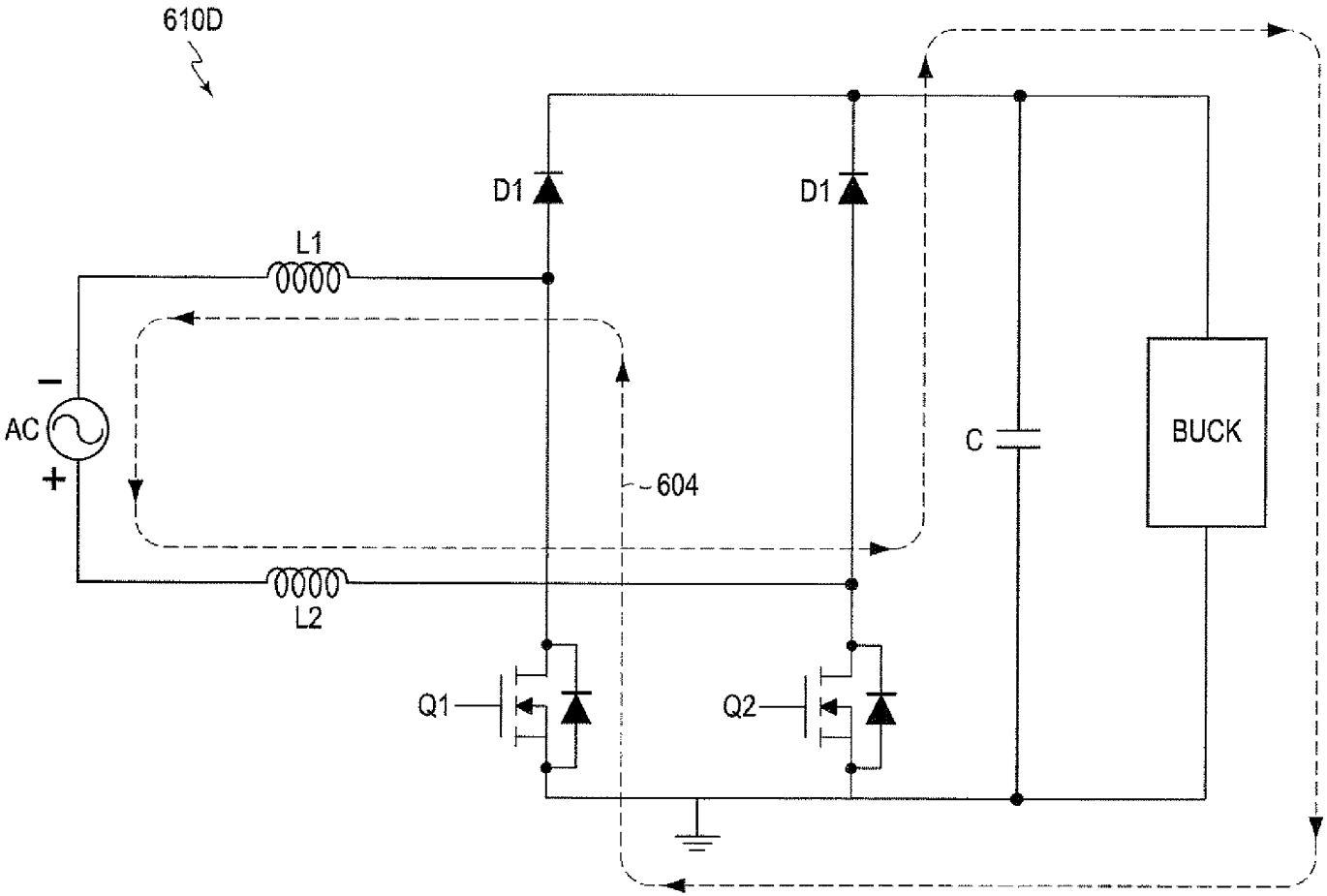

When the AC power supply is negative and the transistors Q1 and Q2 are turned off, the direction of the electric current flowing in the driver is shown by 604 in FIG. 6D.

Figure 4A:
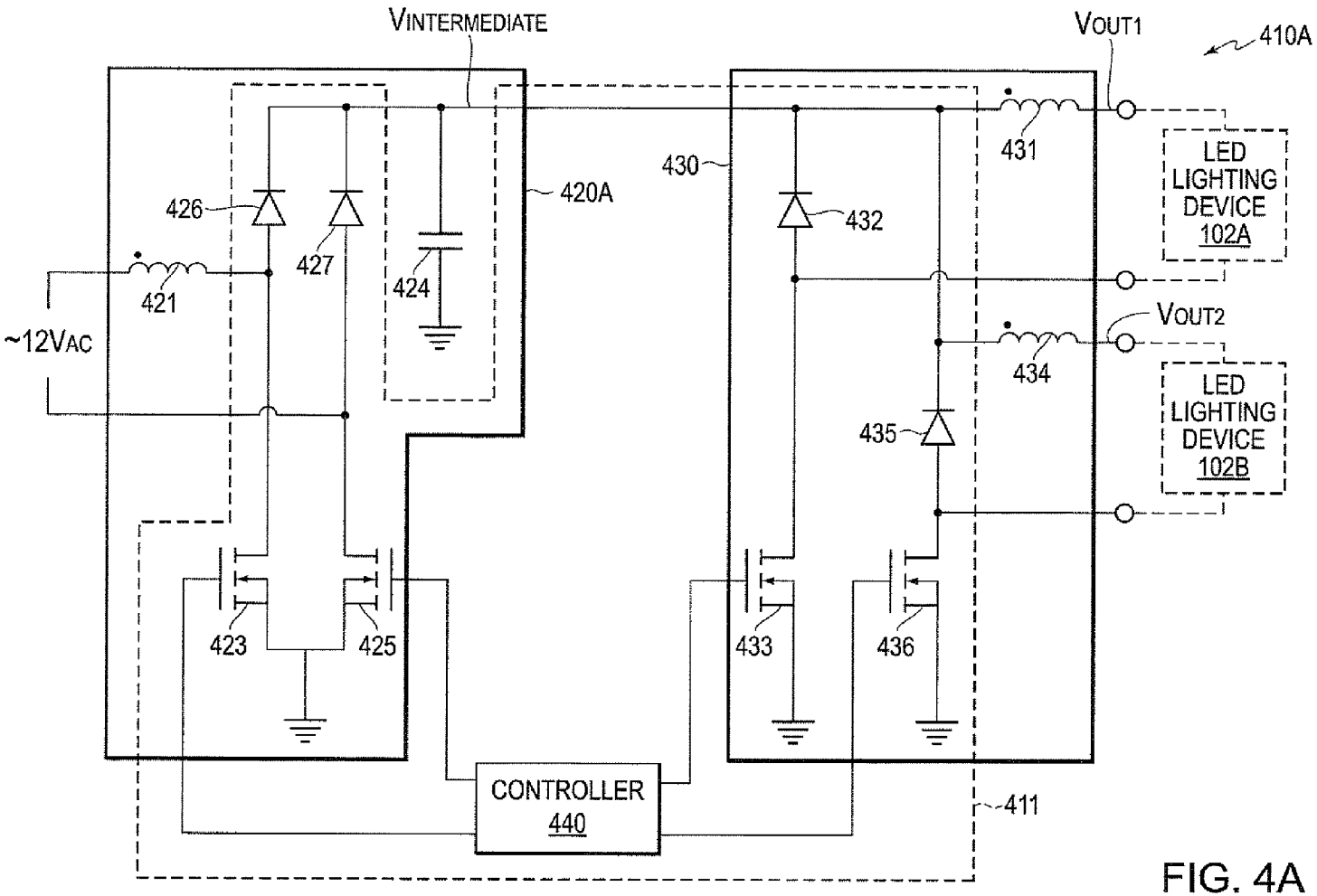
FIG. 4A shows a block diagram of another driver 410A according to an embodiment of the disclosure.

FIG. 4A shows a block diagram of another driver 410A according to an embodiment of the disclosure. The driver 410A can be used in the place of the driver 110 in the electronic system 100. The driver 410A is configured to respectively drive multiple load devices, such as LED lighting device 102A and LED lighting device 102B. The driver 410A includes a boost converter 420A, and a buck converter 430. In addition, in the FIG. 4A example, the driver 410A includes a controller 440. These elements are coupled together as shown in FIG. 4A.

The boost converter 420A operates identically or equivalently to the boost converter 320A. The boost converter 420A utilizes components that are identical or equivalent to those used in boost converter 320A; the description of these components has been provided above and will be omitted here for clarity purposes.

The buck converter 430 receives an intermediate voltage $V_{INTERMEDIATE}$, generates a first output voltage $V_{OUT1}$ to drive a first load device, such as the LED lighting device 102A, and generates a second output voltage $V_{OUT2}$ to drive a second load device, such as the LED lighting device 102B, and respectively regulates a driving current to the LED lighting devices 102A and 102B. The LED lighting devices 102A and 102B can be the same type or can be different types. In an example, the LED lighting devices 102A and 102B have a same number of serially connected light emitting diodes. In another example, the LED lighting devices 102A and 102B have different numbers of serially connected light emitting diodes.

In the FIG. 4A example, the buck converter 430 includes a first inductor 431, a second inductor 434, a first switch 433, a second switch 436, a first diode 432, and a second diode 435.

The first inductor 431, the first switch 433, and the first diode 432 are coupled together to form a first buck converter. The first buck converter operates identically or equivalently to the buck converter 230. The first buck converter utilizes components that are identical or equivalent to those used in buck converter 230; the description of these components has been provided above and will be omitted here for clarity purposes.

The second inductor 434, the second switch 436, and the second diode 435 are coupled together to form a second buck converter. The second buck converter operates identically or equivalently to the buck converter 230. The second buck converter utilizes components that are identical or equivalent to those used in buck converter 230; the description of these components has been provided above and will be omitted here for clarity purposes.

In the FIG. 4A example, the controller 440 respectively provides first pulses to the first switch 433, and second pulses to the second switch 436, and respectively adjusts duty cycle of the first pulses and duty cycle of the second pulses to generate the output voltage $V_{OUT1}$ for the LED lighting device 102A, and output voltage $V_{OUT2}$ for the LED lighting device 102B.

In an example, the controller 440 receives a first feedback signal (not shown) indicative of a current level of a first current flowing in the LED lighting device 102A, and adjusts the duty cycle of first pulses to a gate terminal of the transistor 433 based on the first feedback signal to obtain an appropriate output voltage $V_{OUT1}$ to the LED lighting device 102A, and regulates the current flowing in the LED lighting device 102A.

Further, the controller 440 receives a second feedback signal (not shown) indicative of a current level of the second current flowing in the LED lighting device 102B, and adjusts the duty cycle of second pulses to the gate terminal of the transistor 436 based on the second feedback signal to obtain an appropriate output voltage $V_{OUT2}$ to the LED lighting device 102B, and regulates the current flowing in the LED lighting device 102B.

According to an embodiment of the disclosure, the transistors 423, 425, 433 and 436, the controller 440, and the diodes 426, 427, 432 and 435 are implemented on an integrated circuit (IC) chip 411. The IC chip 411 includes I/O pins that couple a circuit in the IC chip 411 with other components of the driver 410A.

It is noted that, in another embodiment, the transistors 423, 425, 433 and 436, the controller 440, and the diodes 426, 427, 432 and 435 are implemented on multiple IC chips (not shown).

It is noted that the driver 410A can be suitably modified.

Figure 4B:
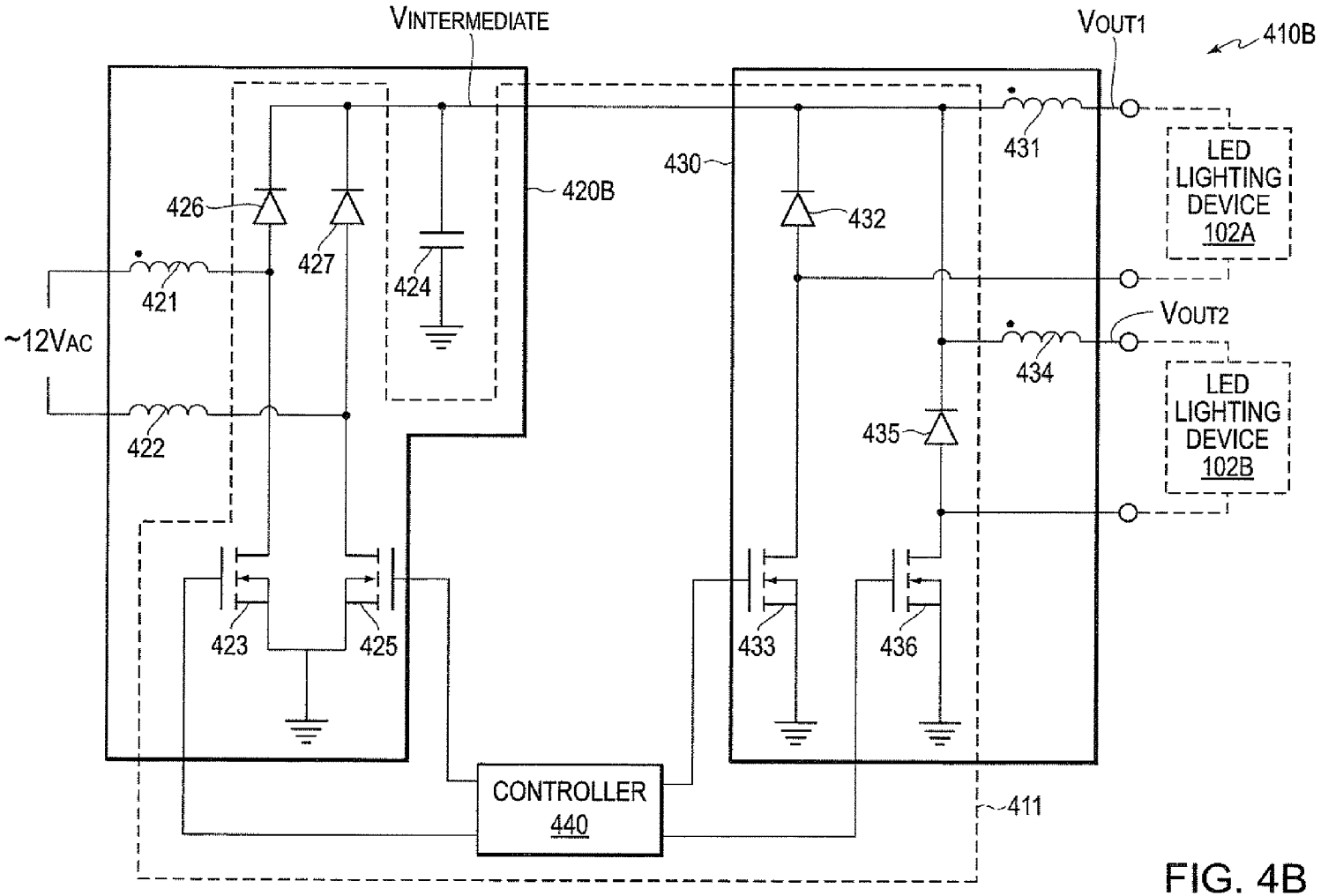
FIG. 4B shows a block diagram of another driver 410B according to an embodiment of the disclosure.

FIG. 4B shows a block diagram of another driver 410B according to an embodiment of the disclosure. The driver 41013 utilizes certain components that are identical or equivalent to those used in the driver 410A; the description of these components has been provided above and will be omitted here for clarity purposes. The driver 410B also operates similarly to the driver 410A.

In the driver 410B, the booster converter 420B includes two inductors 421 and 422 that are respectively coupled to the two terminals of the AC power supply.

Figure 5:
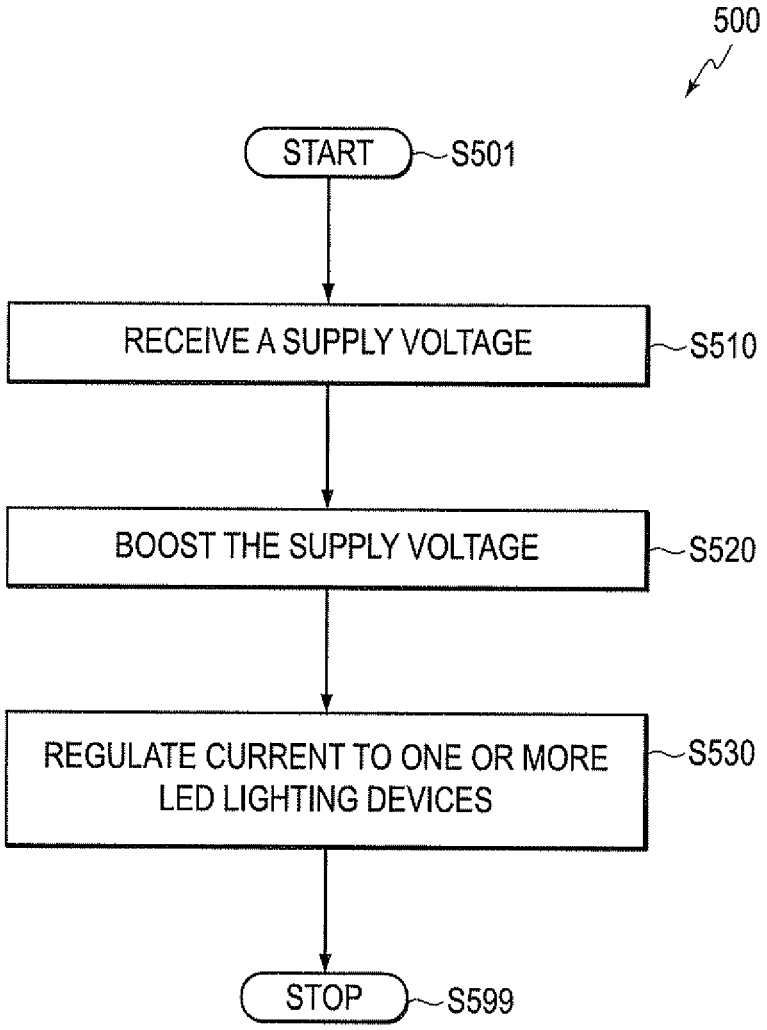
FIG. 5 shows a flow chart outlining a process example 500 according to an embodiment of the disclosure.

FIG. 5 shows a flow chart outlining a process example 500 for an LED driver, such as the driver 110, according to an embodiment of the disclosure. The process starts at S501 and proceeds to S510.

At S510, the driver 110 receives a power supply, such as the 12V AC power supply from the electronic transformer 101.

At S520, the driver 110 includes the boost converter 120 as a first stage to boost the supply voltage. For example, the boost converter 120 generates the intermediate voltage having a voltage level higher than the peak voltage of the 12V AC power supply.

At S530, the driver 110 includes the buck converter 130 as a second stage to provide suitable driving voltage for the LED lighting device 102, and to regulate the current flowing through the LED lighting device 102. In an embodiment, the driver 110 includes multiple buck converters respectively drive multiple load devices. The process then proceeds to S599 and terminates.

It is noted that while the examples in FIGS. 2-4 use N-type MOSFET transistors, the examples can be modified to use P-type MOSFET transistors. It is also noted that the examples can be modified to use other type of transistors, such as bipolar transistors and the like.

While aspects of the present disclosure have been described in conjunction with the specific embodiments thereof that are proposed as examples, alternatives, modifications, and variations to the examples may be made. Accordingly, embodiments as set forth herein are intended to be illustrative and not limiting. There are changes that may be made without departing from the scope of the claims set forth below.

What is claimed is:

1. A circuit, comprising:

a first switch in a boost circuit, the first switch being switched on and off to transfer electric energy from an input power supply to a capacitor to generate an intermediate power supply having a higher voltage than the input power supply;

a second switch in a buck circuit to provide a first driving voltage based on the intermediate power supply to drive a first load device, the second switch being switched on and off to regulate a first current to the first load device, the buck circuit including a first diode and a first inductor, the second switch and the first diode being serially coupled between the intermediate power supply and a ground, the first inductor being coupled between the first diode and the first load device;

a third switch in the buck circuit to provide a second driving voltage based on the intermediate power supply to drive a second load device, the third switch being switched on and off to regulate a second current to the second load device, the buck circuit including a second diode and a second inductor, the third switch and the second diode serially coupled between the intermediate power supply and the ground, the second inductor being coupled between the second diode and the second load device; and a controller configured to provide a first signal to the first switch, a second signal to the second switch, a third signal to the third switch to switch on and off the first switch, the second switch, and the third switch.

2. The circuit of claim 1, wherein the first switch is switched on and off to transfer the electric energy from an alternating current (AC) power supply generated from an electronic transformer.

3. The circuit of claim 2, wherein the first switch is switched on and off to transfer the electric energy through a rectifier that rectifies the AC power supply to have a single polarity.

4. The circuit of claim 2, wherein the first switch is a transistor, the boost circuit includes the transistor, an inductor, a diode and the capacitor coupled in a boost configuration, the second switch is another transistor, and the buck circuit includes the other transistor, the first inductor and the first diode coupled in a buck configuration.

5. The circuit of claim 4, wherein the transistor is a first transistor, the first transistor and the first diode are forward-biased when the AC power supply has a first polarity and are reverse-biased to be decoupled from the first inductor and the capacitor when the AC power supply has a second polarity;

a third transistor and a third diode are forward-biased to be coupled with the first inductor and the capacitor in the boost configuration when the AC power supply has the second polarity; and the controller is configured to provide an additional signal to the third transistor to switch on and off the third transistor.

6. The circuit of claim 5, wherein the controller is configured to provide same signals to the first transistor and the third transistor.

7. The circuit of claim 4, wherein the boost circuit includes a third inductor.

8. The circuit of claim 1, wherein the load device is a light emitting diode (LED) lighting device.

9. The circuit of claim 1, wherein the controller is configured to provide first pulses having a first duty cycle to the first switch, and provide second pulses having a second duty cycle to the second switch.

10. The circuit of claim 9, wherein the controller is configured to adjust the first duty cycle based on a feedback signal indicative of a voltage level of the intermediate power supply.

11. The circuit of claim 9, wherein the controller is configured to adjust the second duty cycle based on a feedback signal indicative of a current flowing through the load device.

12. An apparatus, comprising:

a first transistor, a first inductor, a first diode, and a capacitor coupled in a boost configuration to generate an intermediate power supply;

a second transistor, a second inductor and a second diode coupled in a buck configuration to provide a first driving voltage based on the intermediate power supply to drive a first load device, the second transistor and the second diode being serially coupled between the intermediate power supply and a ground, the second inductor being coupled between the second diode and the first load device;

a third transistor, a third inductor and a third diode coupled in the buck configuration to provide a second driving voltage based on the intermediate power supply to drive a second load device, the third transistor and the third diode being serially coupled between the intermediate power supply and the ground, the third inductor being coupled between the third diode and the second load device; and a controller configured to provide a first signal to the first transistor to switch on and off the first transistor to transfer electric energy from an input power supply to the capacitor to generate the intermediate power supply having a higher voltage than the input power supply, provide a second signal to the second transistor to switch on and off the second transistor to provide the first driving voltage based on the intermediate power supply to drive the first load device, and provide a third signal to the third transistor to switch on and off the third transistor to provide the second driving voltage based on the intermediate power supply to drive the second load device.

13. The apparatus of claim 12, wherein the input power supply is an alternative current (AC) power supply generated by an electronic transformer.

14. The apparatus of claim 13, further comprising:

a rectifier configured to rectify the AC power supply to a single polarity.

15. The apparatus of claim 13, further comprising a fourth transistor and a fourth diode, wherein the first transistor and the first diode are forward-biased when the AC power supply has a first polarity and are reverse-biased and decoupled from the first inductor and the capacitor when the AC power supply has a second polarity;

the fourth transistor and the fourth diode are forward-biased to be coupled with the first inductor and the capacitor in the boost configuration when the AC power supply has the second polarity; and the controller is configured to provide an additional signal to the fourth transistor to switch on and off the fourth transistor.

16. The apparatus of claim 15, wherein the controller is configured to provide same signals to the first transistor and the fourth transistor.

17. The apparatus of claim 12, wherein the first transistor, the first inductor, the first diode, the capacitor and a fourth inductor are coupled in the boost configuration.

18. The apparatus of claim 12, wherein the controller is configured to adjust a first duty cycle of first pulses to the first transistor based on a first feedback signal indicative of a voltage level of the intermediate power supply, and to adjust a second duty cycle of second pulses to the second transistor based on a second feedback signal indicative of a current flowing through the first load device.

19. A method, comprising:

providing first pulses to a first switch in a boost circuit to switch on and off the first switch in order to transfer electric energy from an input power supply to a capacitor to generate an intermediate power supply having a higher voltage than the input power supply;

providing second pulses to a second switch in a buck circuit to provide a first driving voltage based on the intermediate power supply to drive a first load device and regulate a first current to the first load device, the buck circuit including a first diode and a first inductor, the second switch and the first diode being serially coupled between the intermediate power supply and a ground, the first inductor being coupled between the first diode and the first load device; and providing third pulses to a third switch in the buck circuit to provide a second driving voltage based on the intermediate power supply to drive a second load device and regulate a second current to the second load device, the buck circuit including a second diode and a second inductor, the third switch and the second diode being serially coupled between the intermediate power supply and the ground, the second inductor being coupled between the second diode and the second load device.

20. The method of claim 19, further comprising:

providing the first pulses to the first switch and a fourth switch.

* * * * *